United States Patent [19]

Schafer et al.

[11] Patent Number: 4,486,726

[45] Date of Patent: Dec. 4, 1984

[54] JOINT BETWEEN COAXIAL CABLE AND MICROWAVE COMPONENT

[75] Inventors: Robert H. Schafer, Perkasie, Pa.; Andreas Bosshard, Herisau, Switzerland

[73] Assignees: UTI Corporation, Collegeville, Pa.; Huber & Subner Ltd., Herisau, Switzerland

[21] Appl. No.: 433,295

[22] Filed: Oct. 7, 1982

[51] Int. Cl.[3] ..... H01P 1/04

[52] U.S. Cl. ..... 333/260; 174/88 C; 339/177 R

[58] Field of Search ..... 333/260; 339/177 R; 174/88 C

[56] References Cited

U.S. PATENT DOCUMENTS

| | | | |
|---|---|---|---|
| 3,109,052 | 10/1963 | Damire et al. | 339/177 R X |
| 3,528,052 | 9/1970 | Brishka | 333/260 X |
| 4,161,704 | 7/1979 | Schafer | 333/33 |
| 4,266,207 | 5/1981 | Schafer | 333/206 |
| 4,346,355 | 8/1982 | Tsukii | 333/260 X |
| 4,370,630 | 1/1983 | Capek et al. | 333/260 X |

FOREIGN PATENT DOCUMENTS

| | | | |
|---|---|---|---|
| 0027680 | 4/1981 | European Pat. Off. | 339/177 R |

OTHER PUBLICATIONS

Recent Advertisement Narda Microwave Corp.

Ad for Minipad Attenuator, Microwaves, Aug. 1982, p. 68.

Ad for SMA Attenuator, Microwave Journal, Aug. 1982, p. 72.

*Primary Examiner*—Paul Gensler

*Attorney, Agent, or Firm*—Seidel, Gonda & Goldhammer

[57] ABSTRACT

One end of a coaxial cable is telescoped into one end of a microwave component such as an attenuator with the outer jacket of the cable being metallurgically bonded to the metal housing of the component.

8 Claims, 2 Drawing Figures

FIG. 1
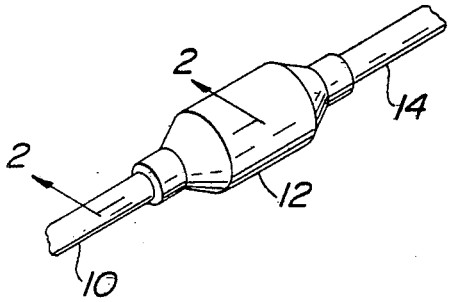
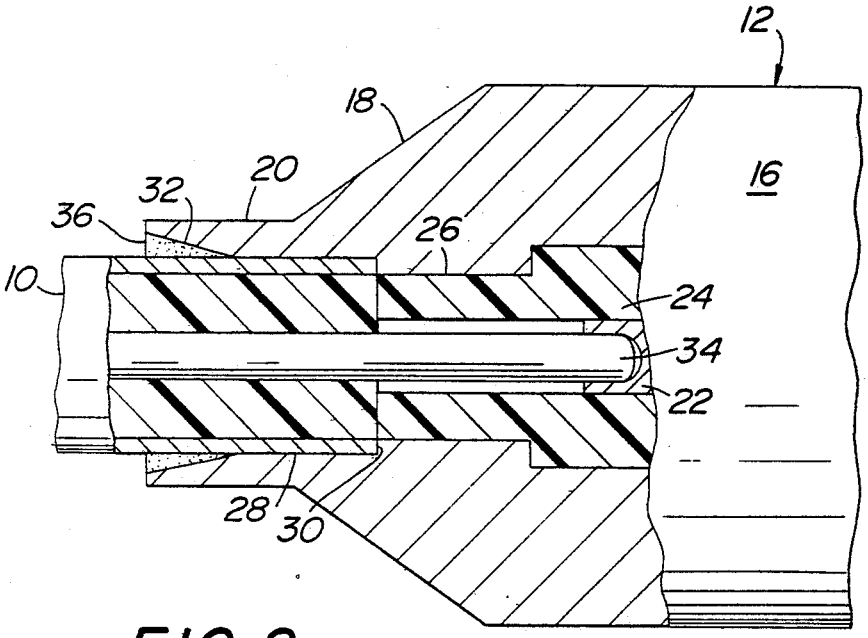
FIG. 2

JOINT BETWEEN COAXIAL CABLE AND MICROWAVE COMPONENT

BACKGROUND OF THE INVENTION

U.S. Pat. No. 4,161,704 discloses a coaxial cable with circuit components disposed therewithin. As noted in said patent, a typical OD range of the coaxial cable is 0.034–0.250 inches. If the transverse dimensions of the circuit component greatly exceed the OD of the coaxial cable, the component cannot be integrated into the cable. Heretofore, it has been conventional to provide a threaded connection between one end of the cable and one end of such components.

Threaded connectors on such a component such as an attenuator can have transverse dimensions greater than that of the attenuator. Threaded connectors increase the length and weight of the microwave component and constitute areas for potential losses.

There is a need for more reliability, less weight, and shorter lengths for the microwave component. The present invention is directed to a solution of that problem.

SUMMARY OF THE INVENTION

The present invention is directed to a joint between a coaxial cable and a microwave component such as an attenuator having a tubular metal housing with connecting means on each end. A coaxial cable having a metal outer jacket is connected to one end of the microwave component having a female receptacle in a first axial bore. A dielectric surrounds the receptacle and is positioned between the surface of the bore and the receptacle. The one end of said component terminates with a second axial bore communicating with the first axial bore.

The diameter of the second axial bore is greater than the diameter of the first axial bore so as to define a radial shoulder. The coaxial cable has a center conductor projecting beyond an end face. The coaxial cable extends into the second bore so that its end face contacts said shoulder. The cable center conductor contacts the receptacle. The aforementioned one end of said component is metallurgically bonded to the outer jacket of said coaxial cable in any convenient manner such as by soldering.

Various objects and advantages of the present invention will be set forth hereinafter.

For the purpose of illustrating the invention, there is shown in the drawings a form which is presently preferred; it being understood, however, that this invention is not limited to the precise arrangements and instrumentalities shown.

FIG. 1 is a perspective view of a length of coaxial cable connected to the opposite ends of a microwave component such as an attenuator.

FIG. 2 is an enlarged detail view showing the manner at which one end of the cable is connected to one end of the microwave component.

DETAILED DESCRIPTION

Referring to the drawing in detail, wherein like numerals indicate like elements, there is shown in FIG. 1 a coaxial cable section 10 connected to one end of a microwave component 12. The other end of the component 12 is connected to a coaxial cable section 14. The coaxial cable sections 10 and 14 are preferably constructed as taught by U.S. Pat. No. 4,161,704 so as to have a central conductor surrounded by a dielectric sleeve which is surrounded by a metal jacket of a conductive material such as copper. The dielectric material is under compression so as to eliminate any air gap between the jacket and the dielectric and between the dielectric and the center conductor. A typical OD for the coaxial cable sections is 0.086 inches.

The microwave component 12 is preferably an attenuator but may be any other comparable component. An attenuator is a network of series and parallel resistors designed to absorb energy and produce a specified loss when inserted between two impedances to which the input and out impedances of the attenuator are matched. Thus, attenuation is a reverse of amplification.

One example of a microwave attenuator is Model No. 6810.19.A, 10 dB dc-18 $Gh_z$ made by Huber & Suhner of Herisau, Switzerland. The attenuator 12 has a tubular conductive metallic housing whose outer diameter is approximately 0.248 inches. The housing 16 was modified so as to have reduced weight. Thus, at each end there is provided a tapered surface 18 extending from the outer peripheral surface of the housing 16 to an axially extending projection 20 of reduced diameter. The length of each projection is about 14% of the length of housing 16.

The attenuator network within the housing 16 is a conventional thin film resistive attenuator element deposited on a ceramic substrate. The housing 16 may be split transversely or longitudinally to facilitate mounting the network therein. One end of the network is connected to a center conductor having a female receptacle 22. Receptacle 22 is surrounded by a dielectric sleeve 24. The outer periphery of sleeve 24 is in intimate contact with a first bore 26 axially disposed within the housing 16. One end of bore 26 is in direct communication with one end of a larger diameter bore 28 which extends from a radial shoulder 30. The other end of bore 28 preferably has a tapered portion 32. When the diameter of housing 16 is 0.248 inches, the outer diameter of projection 20 may be 0.122 inches.

One end of the coaxial cable section 10 is telescoped into the bore 28 with the end face of the coaxial cable abutting the shoulder 30. The center conductor 34 contacts the receptacle 22. The outer jacket of the coaxial cable section 10 is metallurgically bonded to the projection 20 such as by solder 36. The other end of component 12 is preferably coupled to the coaxial cable section 14 in the same manner or may be connected to some other component or conventional connector in any desired manner.

When each end of the component 12 is connected to the coaxial cable sections 12 and 14 as described above, the transverse dimensions of the system are dictated by the transverse dimensions of the component 12. By eliminating further connections, the maximum transverse dimensions of the system have been reduced by one sixteenth of an inch, and eliminating threaded connectors has reduced the overall length of the component by more than 50%. A conventional miniature attenuator with SMA threaded connectors has an overall length of 1.8 inches whereas the comparable structure of the present invention has a length of 0.7 inches. Reliability has been improved since a soldered connection is more reliable than a threaded connection. By eliminating the threaded connectors, the weight of the component has been reduced. A conventional miniature attenuator with threaded SMA connectors at its ends weighs 0.406 oz. whereas the comparable structure of the present invention weighs only 0.069 oz.

The present invention permits assembly more quickly and less expensively by eliminating threaded connectors. Housing 16 may be made from anyone of a wide variety of metals such as brass, stainlesss steel, copper but preferably is beryllium copper which has been gold plated. The coaxial cable sections 10 and 14 may be semi-rigid or flexible.

The present invention may be embodied in other specific forms without departing from the spirit or essential attributes thereof and, accordingly, reference should be made to the appended claims, rather than to the foregoing specification, as indicating the scope of the invention.

We claim:

1. A connectorless joint between a coaxial cable and a microwave component comprising a microwave component having a tubular metal housing, a coaxial cable havng a metal outer jacket, one end of said component having an integral female receptacle in a first axial bore, a dielectric surrounding said receptacle and being located between the surface of said bore and said receptacle, said one end of said component terminating at a second axial bore which communicates with one end of said first bore, the diameter of the second bore being greater than the diameter of the first bore so as to define a radial shoulder, the coaxial cable having its center conductor projecting beyond an end face, said cable extending into said second bore with said cable end face contacting said shoulder, said cable center conductor contacting said receptacle, and said one end of said component being metallurgically bonded to the outer jacket of said coaxial cable.

2. A joint in accordance with claim 1 wherein said component is in an attenuator.

3. A joint in accordance with claim 1 wherein said one end of said tubular metal housing is tapered from its outer periphery to an axial projection of reduced diameter.

4. A joint in accordance with claim 1 wherein said jacket and housing are metallurgically bonded by use of solder.

5. A joint in accordance with claim 1 including a second coaxial cable connected to the other end of said component in the same manner.

6. A connectorless joint between a coaxial cable and a microwave component comprising an attenuator having a tubular metal conductive housing, a coaxial cable having a metal outer jacket, one end of said attenuator having an integral female receptacle in a first axial bore, a dielectric surrounding said receptacle and being located between the surface of said bore and said receptacle, said one end of said attenuator terminating at a second axial bore which communicates with one end of said first bore, the diameter of the second bore being greater than the diameter of the first bore so as to define a radial shoulder, the coaxial cable having its center conductor projecting beyond an end face, said cable extending into said second bore with said cable end face contacting said shoulder, said cable center conductor contacting said receptacle, said one end of said tubular metal housing being tapered from its outer periphery to an axial projection of reduced diameter, said projection containing at least a portion of said second bore, and said projection being soldered to the outer jacket of said coaxial cable.

7. A joint in accordance with claim 6 including a second coaxial cable connected to the other end of said attenuator in the same manner.

8. A joint in accordance with claim 6 wherein said attenuator has a length of about 0.7 inches and a weight of about 0.069 oz.

* * * * *